US007243800B1

(12) United States Patent
Feibelman

(10) Patent No.: US 7,243,800 B1
(45) Date of Patent: Jul. 17, 2007

(54) DISPLAY BOX WITH SLEEVE

(75) Inventor: Jeffrey A. Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 485 days.

(21) Appl. No.: 10/884,351

(22) Filed: Jul. 2, 2004

Related U.S. Application Data

(63) Continuation-in-part of application No. 10/197,343, filed on Jul. 17, 2002, now Pat. No. 6,758,340.

(51) Int. Cl.
*B65D 25/54* (2006.01)

(52) U.S. Cl. ..... 206/775; 206/776; 206/474

(58) Field of Classification Search ..... 206/472–475, 206/775–781, 769
See application file for complete search history.

(56) References Cited

U.S. PATENT DOCUMENTS 2,219,183 A * 10/1940 Hartnett et al. ..... 206/733
2,547,849 A * 4/1951 Barry ..... 229/122.34
2,778,487 A * 1/1957 Raeburn ..... 206/459.5
4,739,353 A * 4/1988 Heuer et al. ..... 206/316.2
D309,434 S 7/1990 Goldman ..... D9/433
5,123,527 A 6/1992 Hustad ..... 206/45
5,183,199 A 2/1993 Bills ..... 229/23 A
5,409,105 A * 4/1995 Appelbaum et al. ..... 206/6.1
5,590,779 A 1/1997 Ramsey ..... 206/459.1
6,047,829 A 4/2000 Johnstone et al. ..... 206/531
6,234,308 B1 5/2001 Saffron et al. ..... 206/316.2
6,523,694 B2 * 2/2003 Lux et al. ..... 206/782

* cited by examiner

*Primary Examiner*—Jila M. Mohandesi
(74) *Attorney, Agent, or Firm*—Bainwood Huang

(57) ABSTRACT

A display package which supports an ornamental object therein, and a sleeve including a pair of side tabs which are insertable into the interior of the box in order to removably secure the sleeve to the box is disclosed. The sleeve allows for viewing the ornamental object supported within the box, and is removable from the box in a manner which discourages theft, but is easy to assemble.

19 Claims, 23 Drawing Sheets

DISPLAY BOX WITH SLEEVE

CROSS REFERENCES TO RELATED APPLICATIONS

The present application is a continuation-in-part of U.S. patent application Ser. No. 10/197,343, filed Jul. 17, 2002 now U.S. Pat. No. 6,758,340. The entire contents of the above applications are incorporated herein by reference in entirety.

TECHNICAL FIELD

The invention relates generally to a display package, and more particularly to a package including a box for supporting an ornamental object and a sleeve at least partially disposed over the box through which the ornamental object may be viewed.

BACKGROUND OF RELATED ART

When packaging and displaying an ornamental object, such as a piece of jewelry, the object is often displayed in a package which provides an appealing visual display, while also functioning as a storage or travel container for the article of jewelry. One such package includes a box having an open top, a pad or other base member disposed within the box for supporting the article of jewelry, and a sleeve member positioned over the open box and including a window through which the object may be viewed. In such a package, the sleeve is slid over the open box and can easily be removed by sliding the box from within the sleeve. These types of packages provide a visually appealing and cost effective display for articles of jewelry. However, the sleeve member may be easily removed from the box, either unintentionally or purposely. If unintentionally, the object positioned within the box may become damaged, if purposely, the object may be easily stolen.

Thus, there is continued need in the art for display boxes which can display an ornamental object, such as a piece of jewelry, in an attractive and reliable fashion while also discouraging removal of the object and/or damage to the object disposed therein.

SUMMARY

It is an object of the display package disclosed herein to provide a device for displaying an ornamental object in an attractive and reliable fashion while also discouraging removal of the object and/or damage to the object. In a first embodiment, the display package preferably includes a box having side walls, a top wall, a bottom wall, a back wall, an open front, a base member which supports the ornamental object therein, and a sleeve including a pair of side tabs which are insertable into the interior of the box in order to removably secure the sleeve to the box. The sleeve preferably includes a window or opening for viewing the ornamental object supported within the box, and is removable from the box in a manner which discourages theft, but is easy to assemble. The sleeve is preferably positioned such that a front member overlays the open end of the box, and so that the ornamental object is viewable through the window. The side tabs are preferably folded and inserted between an interior surface of the side walls of the box and the base member. A top tab and a bottom tab are then folded so as to be positioned over and adjacent to the exterior of the top wall and bottom wall of the box, respectively. Thereafter, rear tabs of the sleeve are extended over the exterior of the back wall of the box and are removably interengaged with each other in order to removably secure the sleeve over the box.

In a second embodiment, the display package preferably includes a display box having a bottom member for supporting a display pad which supports an ornamental object, a cover sized to fit over the bottom member in a closed position during use, and a sleeve designed to fit over the display pad and around at least a portion of the bottom member. The sleeve is preferably positioned such that a front member overlays at least a portion of the display pad, and is preferably transparent so that the ornamental object is viewable through the front member. Side tabs are preferably folded and inserted between an interior surface of the side walls of the bottom member and sides of the display pad. Interior tabs are then extended so as to be positioned and secured over a rear surface of the display pad. In order to further secure the sleeve, exterior side tabs are preferably positioned over at least a pair of the side walls of the bottom member. Thereafter, the exterior tabs are extended over the exterior of the back wall of the bottom member and are removably secured over the bottom member. A cover may then be placed over the bottom member to cover the ornamental object in a closed position.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which like reference characters refer to the same parts throughout the different views. The drawings are not necessarily to scale, emphasis instead being placed upon illustrating the principles of the invention.

DETAILED DESCRIPTION OF THE ILLUSTRATIVE EMBODIMENTS

Referring now to FIGS. 1–10, a display container or package 10 including a box 12 for supporting an ornamental object 11 and a sleeve 14 designed to fit over and within the box while allowing the ornamental object to remain visible is illustrated. As used herein, the term "ornamental object" refers to any item or product sold to a consumer including, but not limited to, jewelry. In the present embodiment, the sleeve 14 is partially inserted within the box during assembly in order to secure the sleeve and box together, as described in greater detail below.

Figure 1:
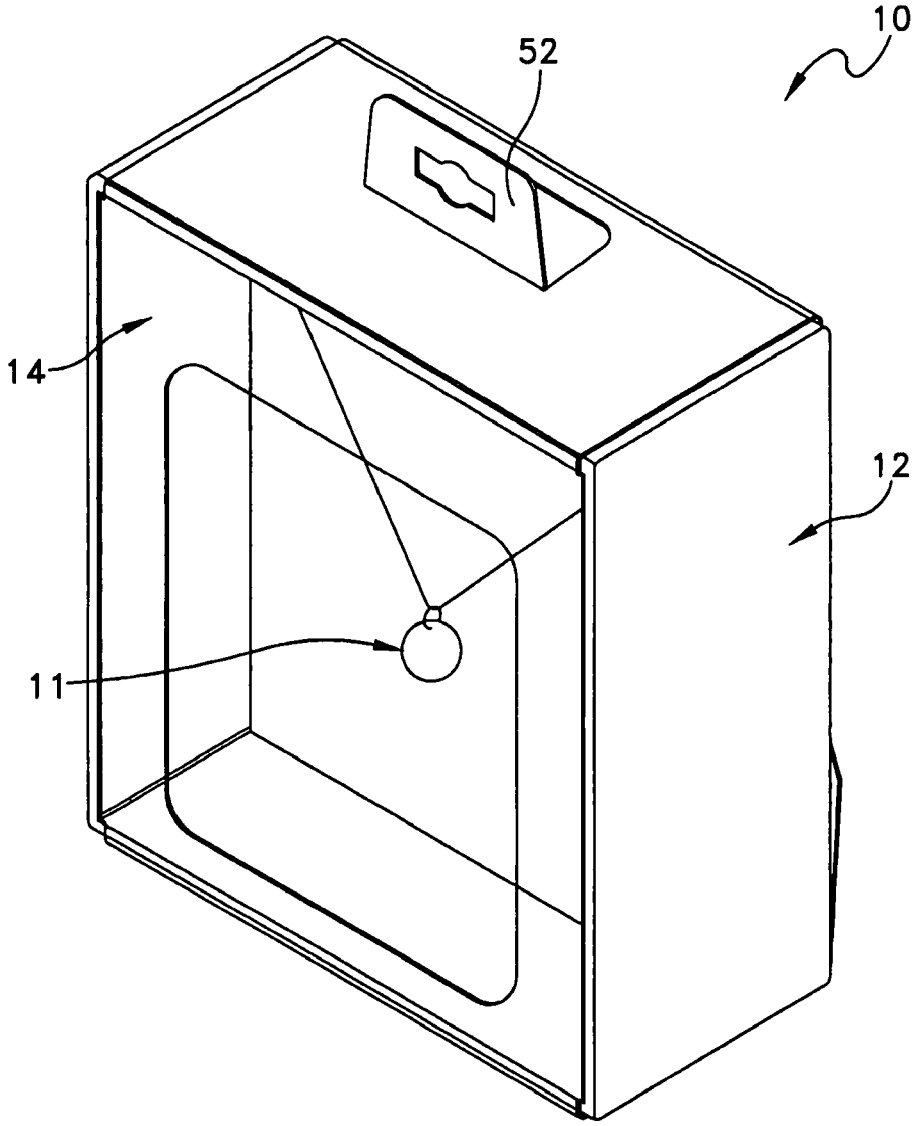
FIG. 1 is a perspective view of the display container with sleeve according to one embodiment.
Figure 2:
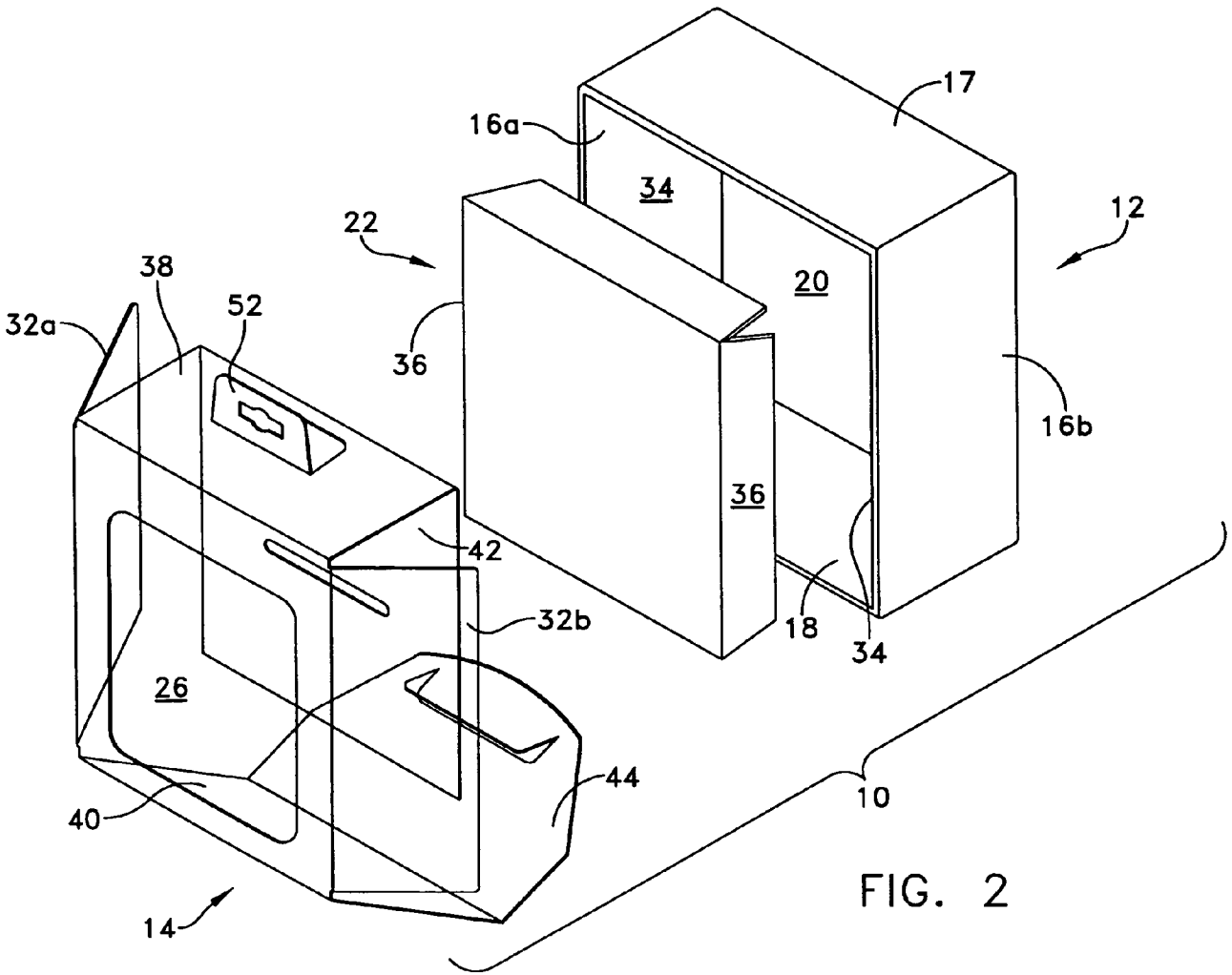
FIG. 2 is an exploded view of the display container of FIG. 1.

As shown in the Figures, the box 12 includes side walls 16*a*, 16*b*, a top wall 17, a bottom wall 18, and a back wall 20. A display pad or base member 22 is also preferably disposed within the box so as to support the ornamental object which is positioned thereon during use. In the present embodiment, the ornamental object is illustrated as a necklace, but any ornamental object may be supported within the box 12, as would be known to those of skill in the art. As best shown in FIG. 2, a front of the box 12 remains open. The box may be made of any suitable material, for example cardboard, as would be known to those of skill in the art. In use, the open end of the box 12 is covered by sleeve 14 which is wrapped around the exterior of the top wall 17, the bottom wall 18, and back wall 20 of the box.

Figure 3:
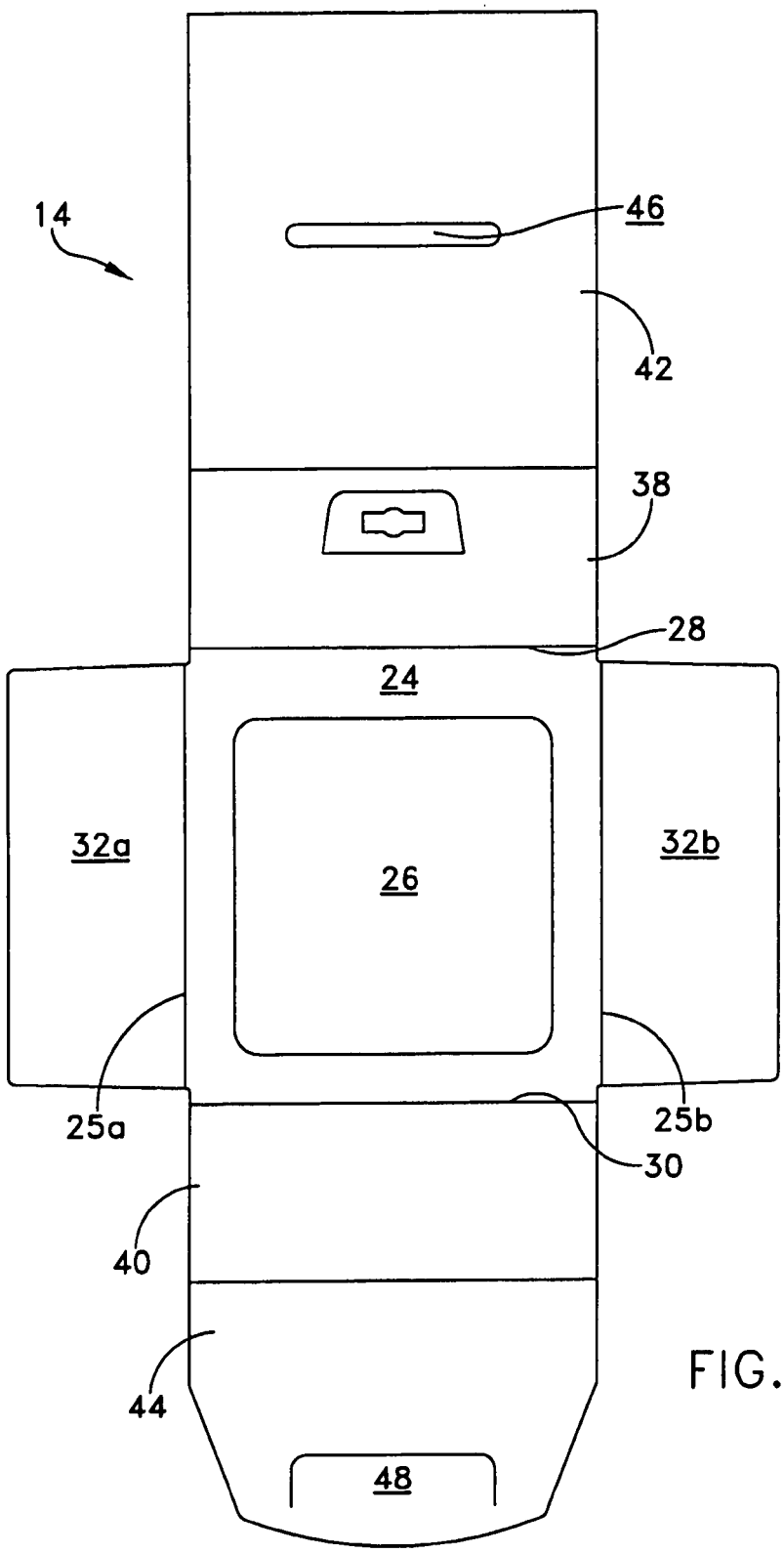
FIG. 3 is a top plan view of the sleeve of FIG. 1.
Figure 4:
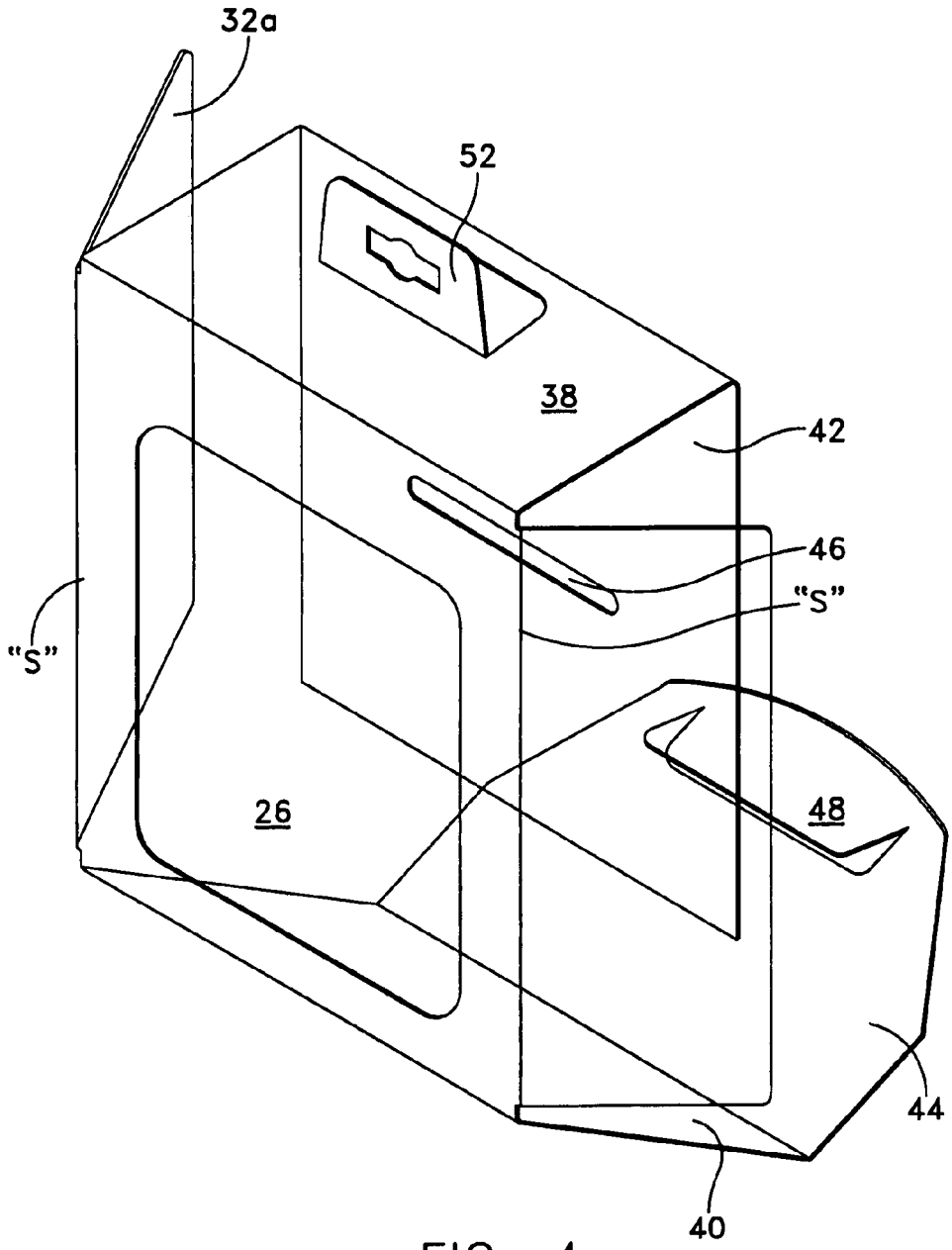
FIG. 4 is a perspective view of the sleeve of FIG. 4 during assembly.
Figure 5:
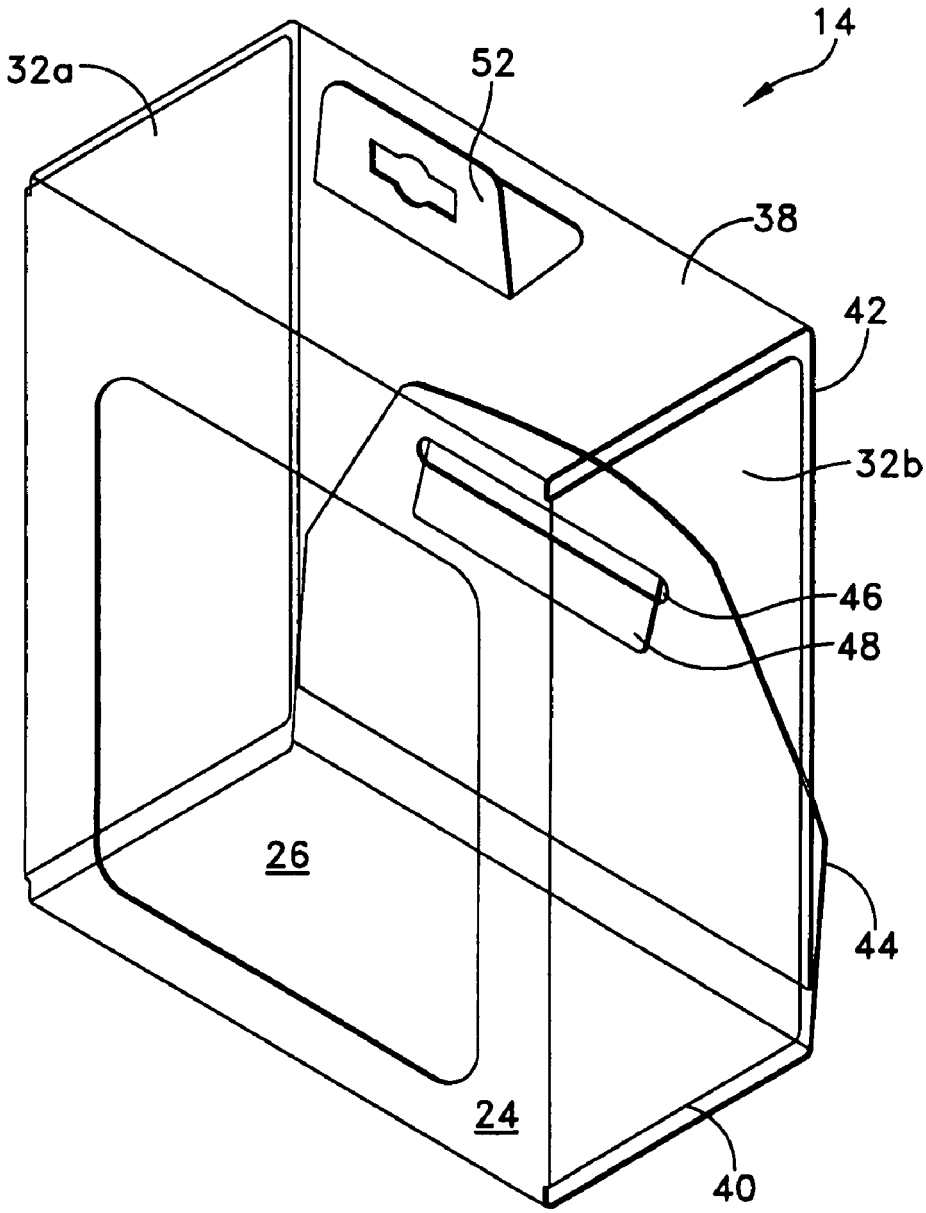
FIG. 5 is a perspective view of the sleeve of FIG. 4 assembled, without the box.

Referring now to FIG. 3, the sleeve 14 preferably includes a front member 24 having an opening or window 26 which is aligned over the open end of the box such that the ornamental object is viewable there through during use. The window may be open to the article of jewelry to allow the consumer to touch it, or may have a protective material, such as plastic, positioned over it to prevent the consumer from touching the object. The sleeve may be made of any suitable material, such as plastic, at least the window portion of the sleeve preferably being transparent. As best shown in FIG. 3, the front member 24 preferably includes a pair of side edges 25*a, b*, a top edge 28, and a bottom edge 30. A pair of foldable side tabs 32*a, b* preferably extend from either pair of the side edges 25*a, b* and are inserted adjacent an interior surface 34 of the side walls 16*a*, 16*b* of the box in order to removably secure the sleeve to the box. In the present embodiment, the side tabs 32*a, b* are inserted between the interior surface 34 of the side walls 16*a*, 16*b* and the sides 36 of the base member 22 in the assembled position. The side tabs 26 may preferably be pre-scored or otherwise have a predetermined weakened area "s" along which the side tabs are folded so as to be readily inserted within the box.

Figure 6:
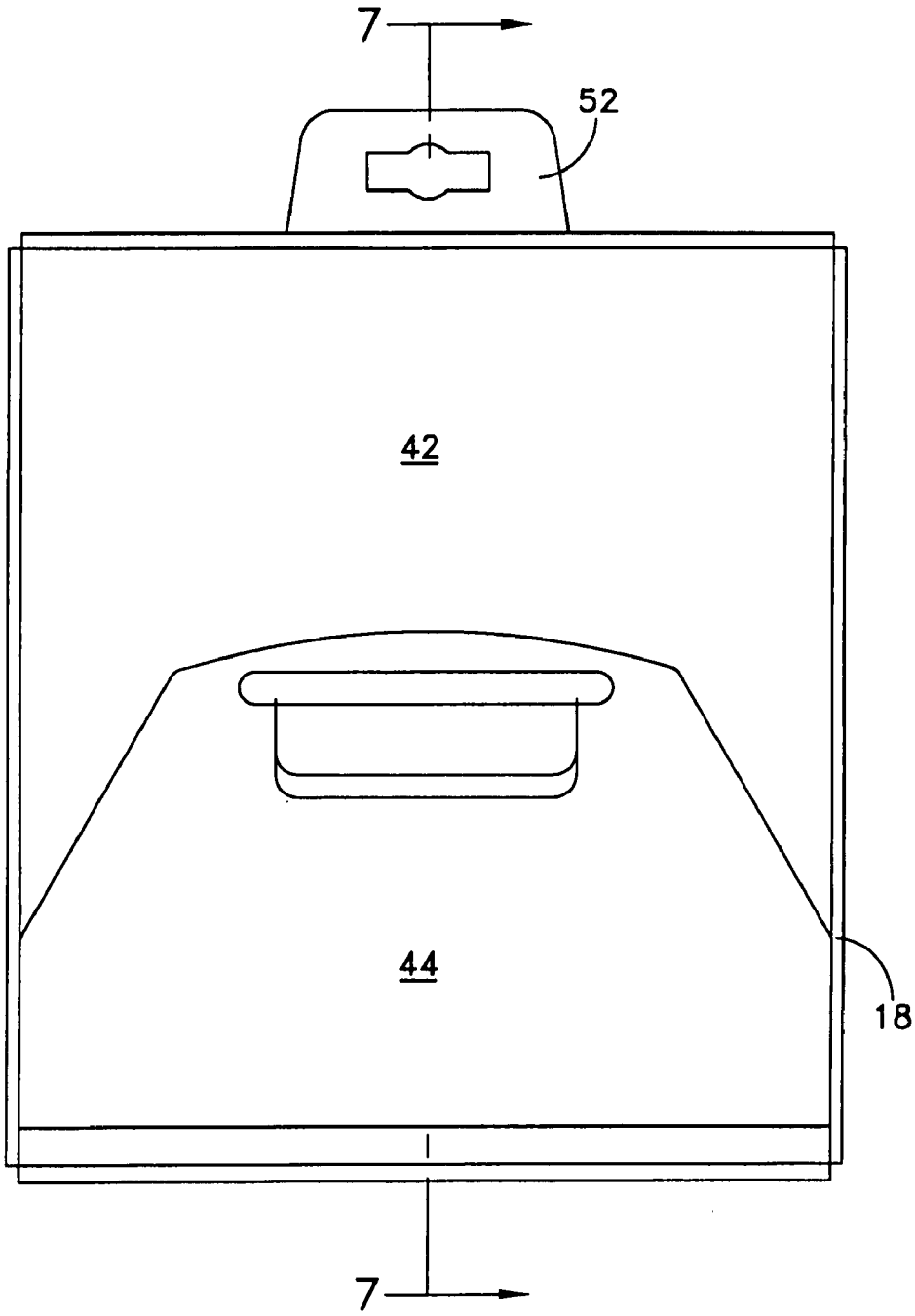
FIG. 6 is a rear plan view of the display container of FIG. 1.
Figure 7:
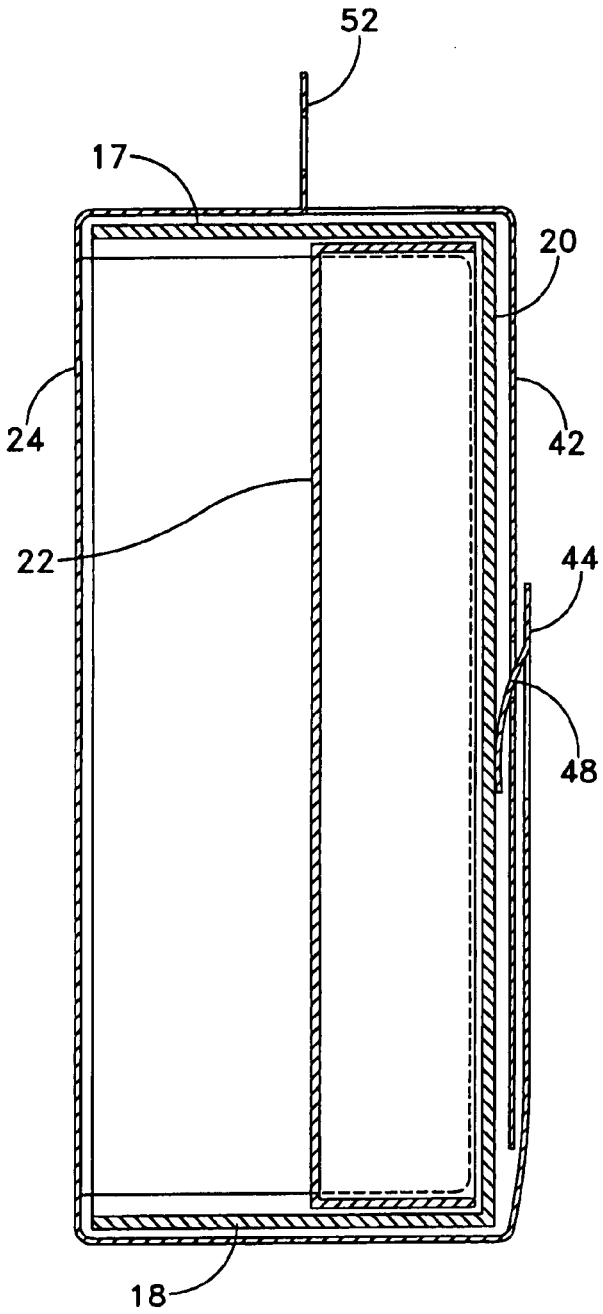
FIG. 7 is a cross-sectional view taken along lines 7—7 of FIG. 6.
Figure 8:
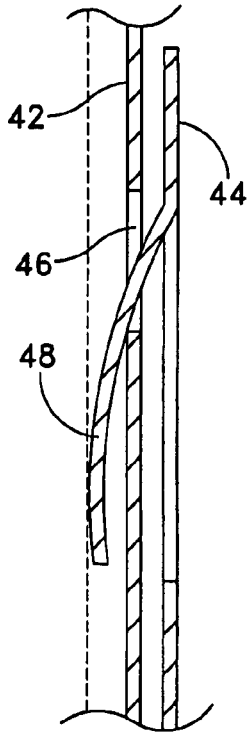
FIG. 8 is an enlarged, cross-sectional view of the rear of the sleeve member in the assembled position.
Figure 9:
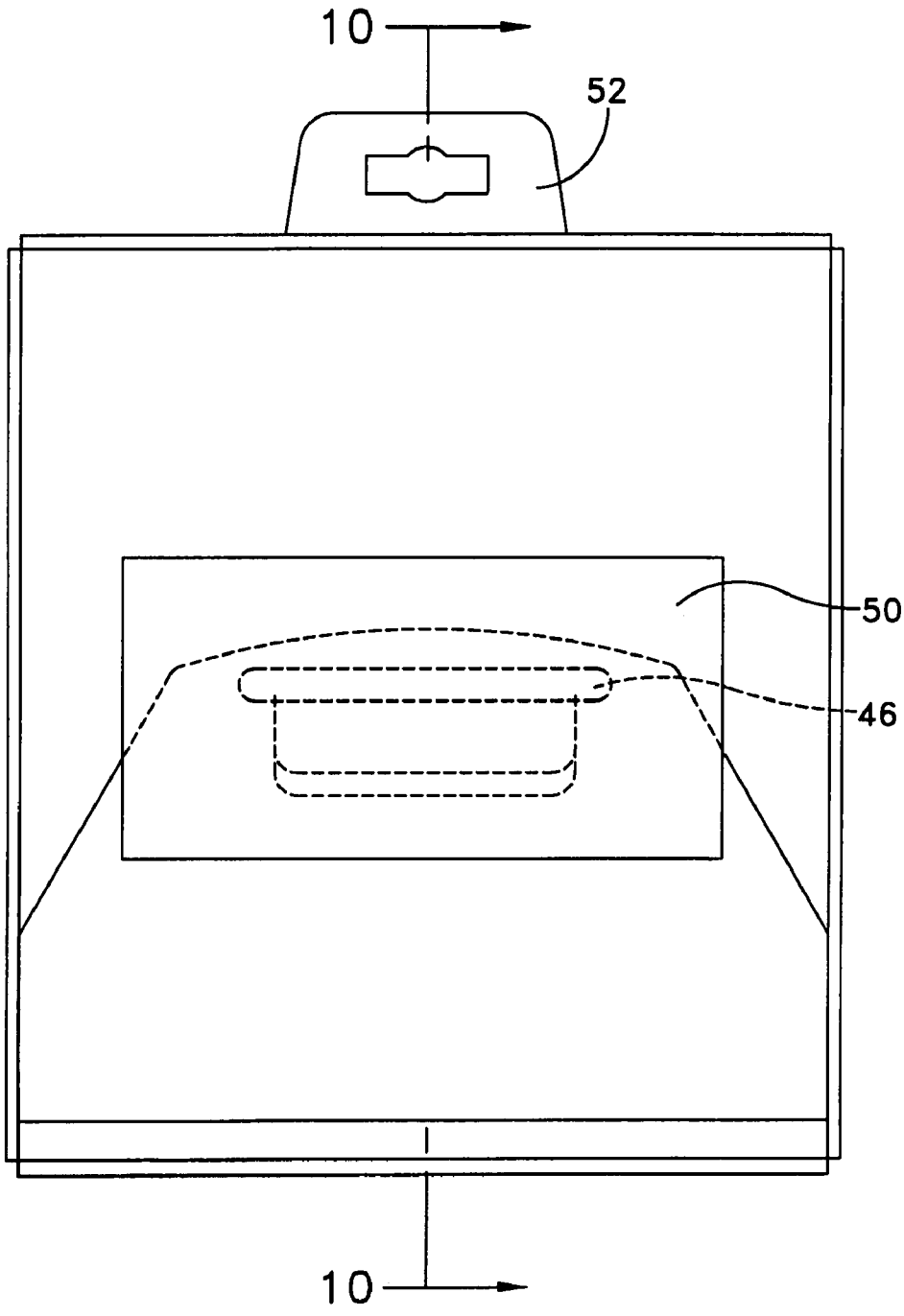
FIG. 9 is a rear plan view of the display container of FIG. 1 with a label attached.
Figure 10:
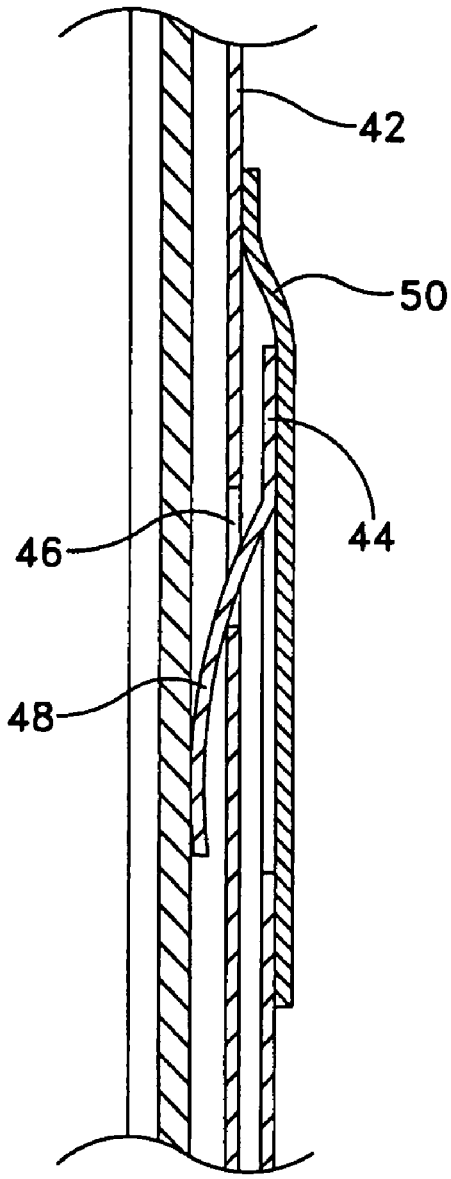
FIG. 10 is a cross-sectional view taken along lines 10—10 of FIG. 9.
Figure 11:
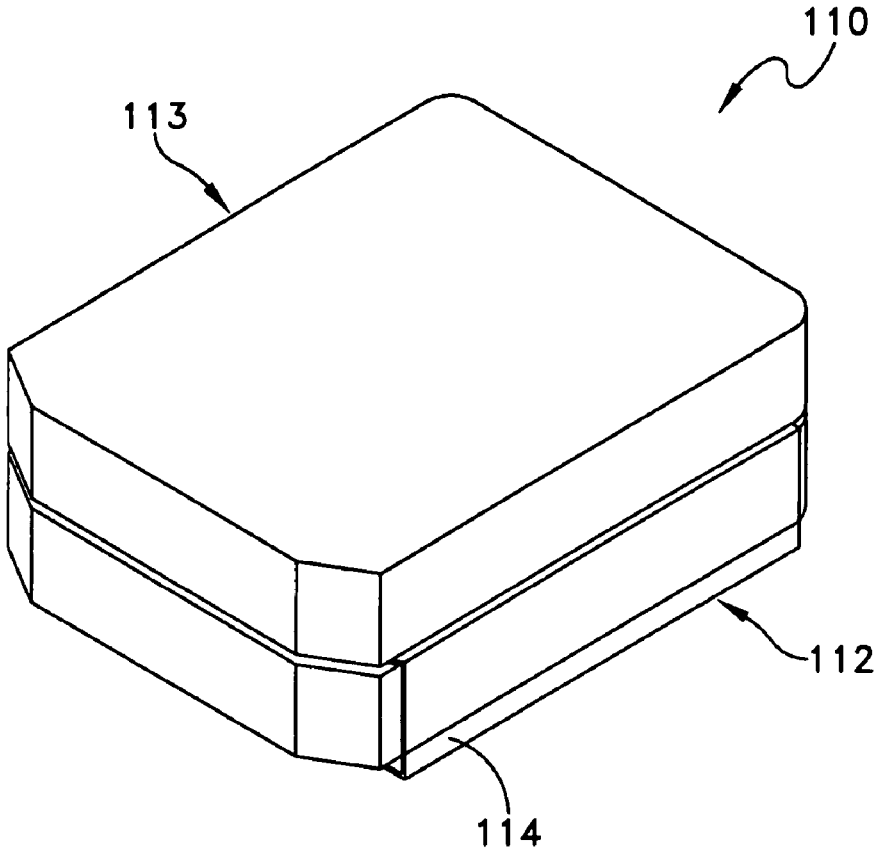
FIG. 11 is a perspective view of a second embodiment of a display container with a sleeve according to a second embodiment.
Figure 12:
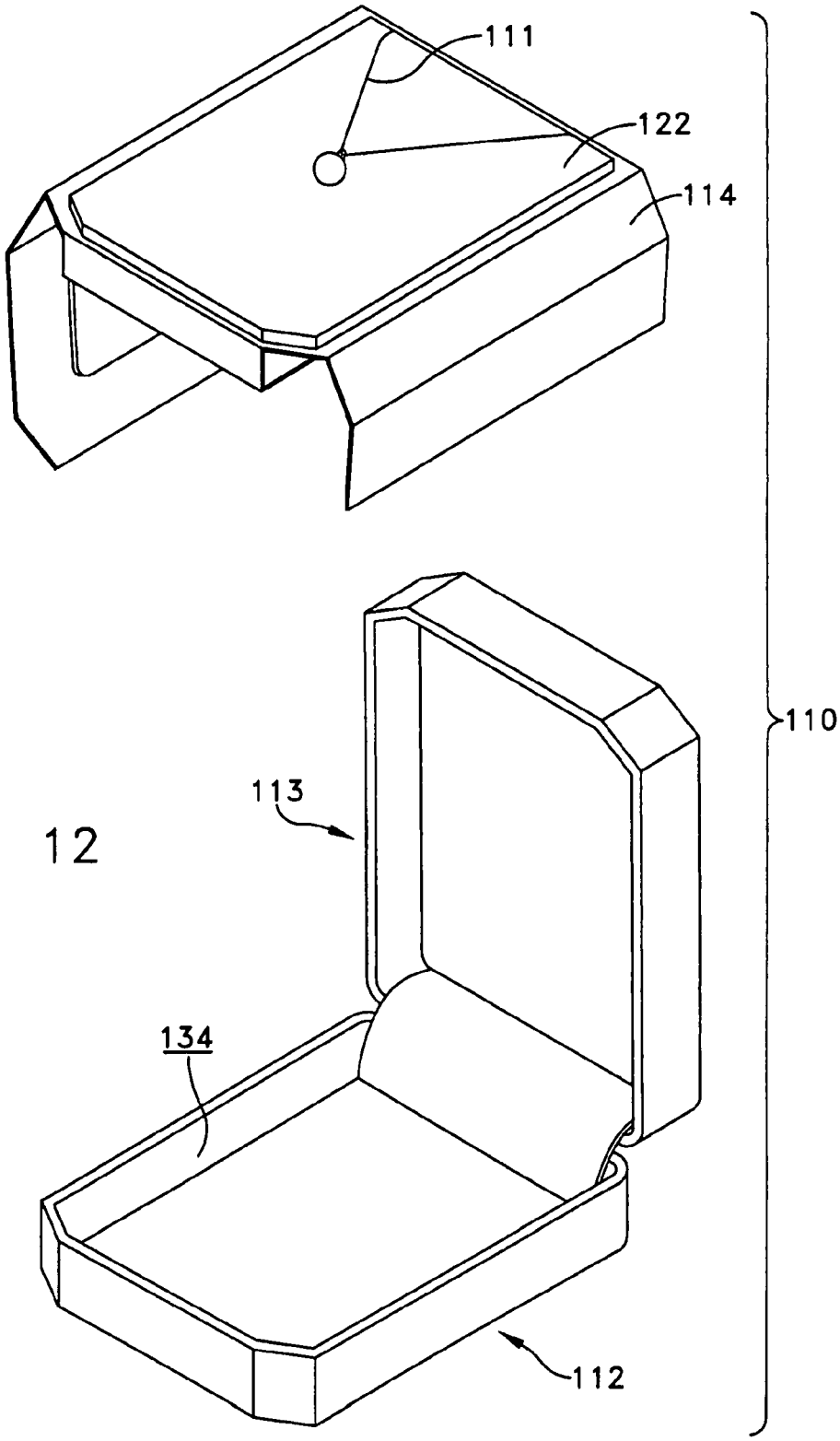
FIG. 12 is a partially exploded view of the display container of FIG. 11.
Figure 13:
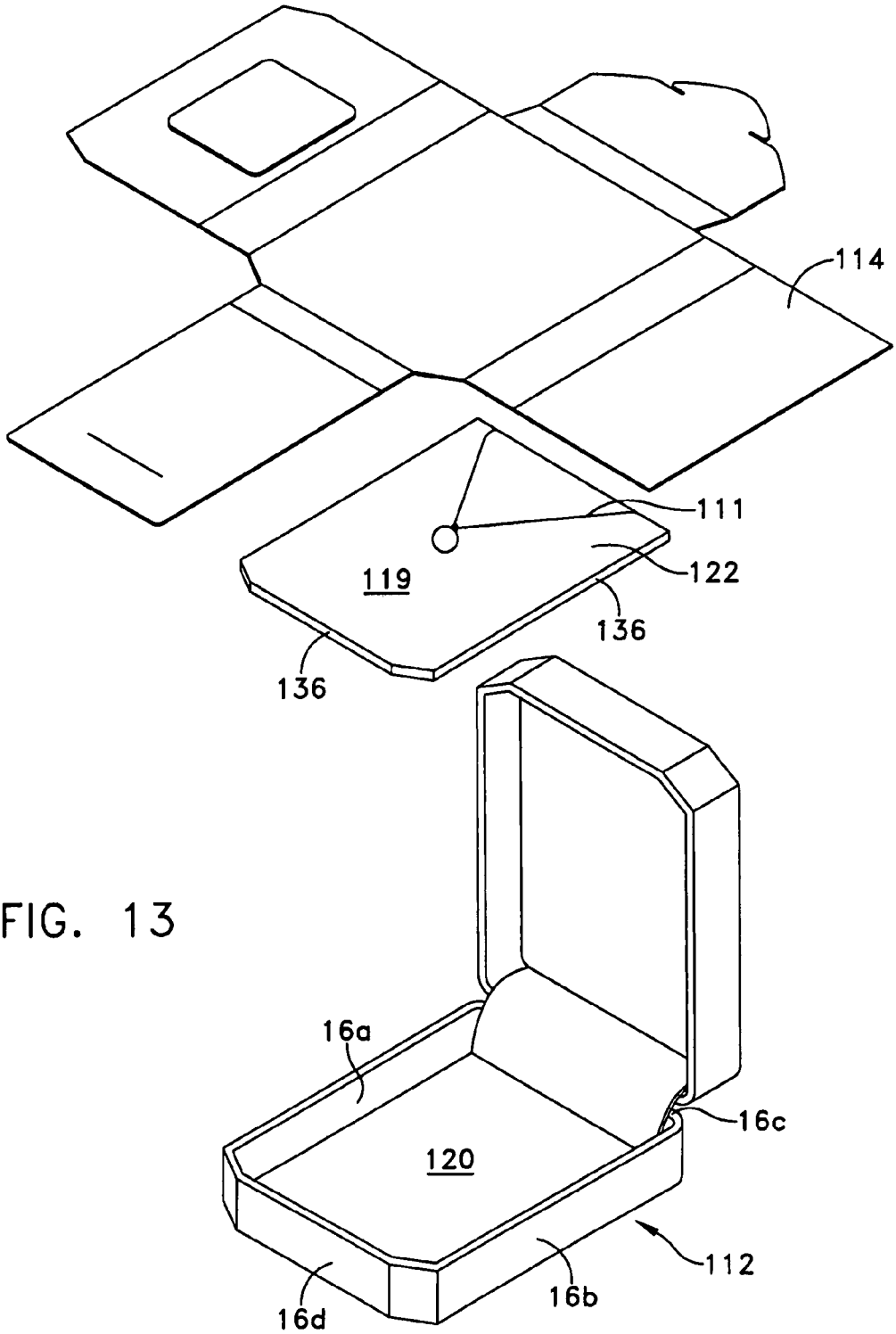
FIG. 13 is an exploded view of the display container of FIG. 11.

In order to position the sleeve over the box once the side tabs are inserted, a foldable top tab 38 and bottom tab 40 are also provided, which extend from the top edge 28 and the bottom edge 30 of the front member 24, respectively. Again, a score line or other predetermined weakened area may be provided between the top and bottom tabs and the front member, both the top and bottom tabs being foldable along the score lines to facilitate placement of the sleeve over the top 17 and bottom 18 walls of the box. In use, the top and bottom tabs are folded so as to be positioned over and adjacent to the exterior of the top and bottom walls 17 and 18 of the box, respectively. Rear tabs 42 and 44 are also provided as part of sleeve 14, a first rear tab 42 extending from the top tab 38, and a second rear tab 44 extending from the bottom tab 40, the first and second rear tabs being inter-engaged in the assembled position. A score line may also be provided between the top and bottom tabs and the rear tabs 42, 44, the rear tabs being foldable along the score lines to facilitate placement of the sleeve over the box. The rear tabs each preferably extend over the back wall of the box and are removably interengaged by a locking member 47 when assembled. In the present embodiment, one of the rear tabs preferably includes an opening or female receptacle 46, while the other tab includes a flap 48 or male member which together form the locking member 47. The flap 48 is insertable within the opening 46 in order to secure the sleeve 14 over the box 12, as best shown in FIGS. 6–8. A label 50 may optionally be positioned over the locking member to conceal the assembly from the public. A hanger 52 may also be provided on the top tab 38 for hanging the display package.

Assembly of the display package will now be described with reference to the Figures. In use, the ornamental object 11 is supported on the base member 22. The base member 22 is inserted within the box 12, such that the sides 36 of the base member are positioned adjacent the interior surface 34 of the box. Once the ornamental object and base member are positioned within the box, the sleeve 14 is positioned around the box. The sleeve 14 is preferably positioned such that the front member 24 overlays the open end of the box 12, and so that the ornamental object 11 is viewable through the window 26. The side tabs 32*a, b* are folded and inserted between the interior surface 34 of the side walls 16*a*, 16*b* and the adjacent sides 36 of the base member 22. The top tab 38 and bottom tab 40 are then folded so as to be positioned over and adjacent to the exterior of the top wall 17 and bottom wall 18 of the box, respectively. Thereafter, the rear tabs 42, 44 are extended over the exterior of the back wall of the box and are removably interengaged by inserting the flap 48 within the opening 46 in order to secure the sleeve 14 over the box 12.

Referring now to FIGS. 11–22, a second embodiment of a display package is illustrated. In this embodiment, all parts which are the same, or similar to, corresponding parts in the first embodiment are noted with the same two last numbers, but preceded by the numeral "1". In this embodiment, display package 110 includes a bottom member 112 for supporting a display pad 122 which supports an ornamental object 111, and a sleeve 114 designed to fit over the display pad 122 and around at least a portion of the bottom member 112. A cover 113 may also be provided which is sized to fit over the bottom member 112 during use.

As shown in the Figures, the bottom member 112 includes one or more side walls 16*a*, 16*b*, 16*c* and 16*d*, as well as a back wall 120. A cover 113 may also be provided which is sized to fit over the bottom member 112 and which is movable between an open and a closed position. In the present embodiment, cover 113 is hingedly secured to the bottom member 112, but alternately may be separate from and not secured to the bottom member, or may be secured to the bottom member in any other manner as known to those of skill in the art. Display pad 122 preferably includes a front surface 119 for supporting the ornamental object 111, and rear surface 121 (FIG. 8) opposite the front surface, and side edges 136. In use, the rear surface 121 of the display pad 122 is positioned adjacent the back wall 120 of the display box 110 while the front surface 119 is at least partially covered by a portion of sleeve 114, as described in greater detail below.

Figure 14:
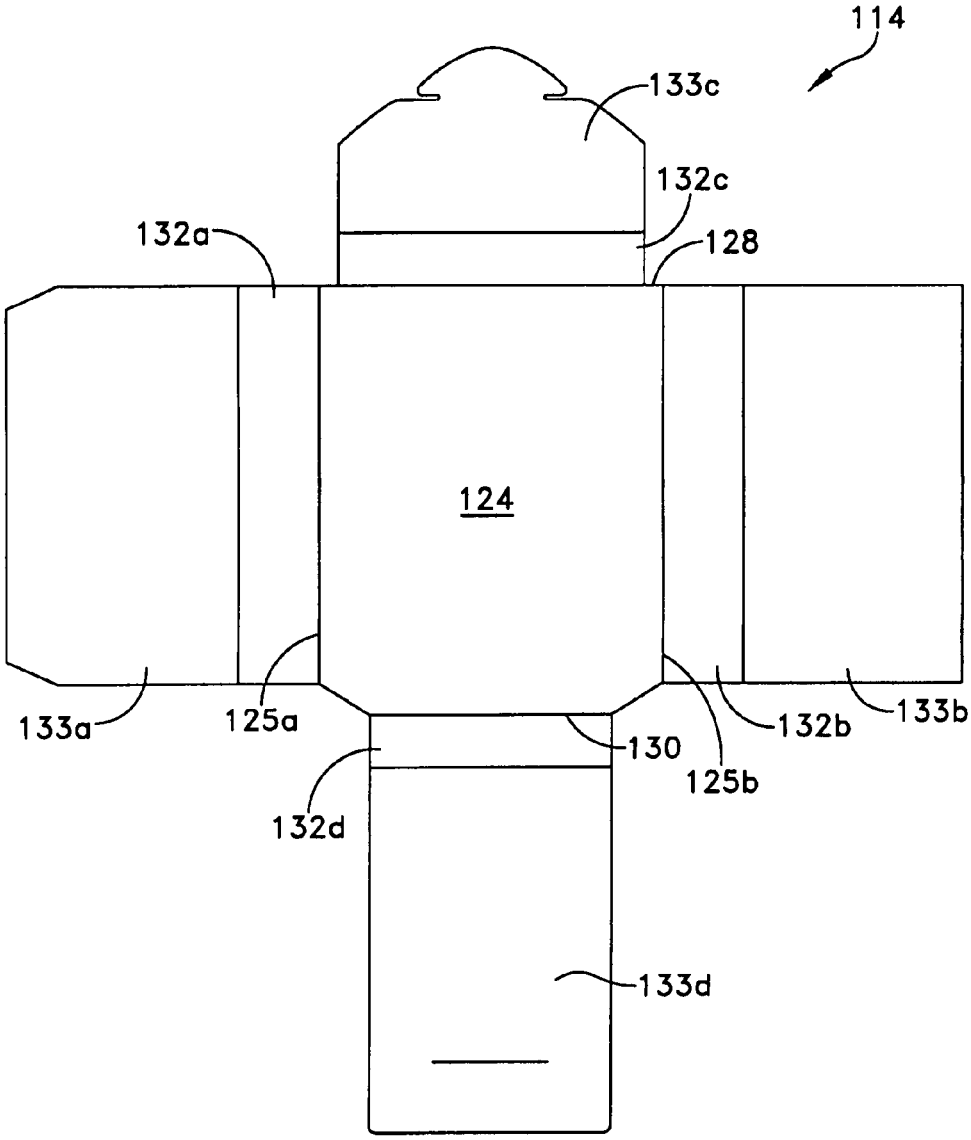
FIG. 14 is a top plan view of the sleeve of FIG. 11.
Figure 15:
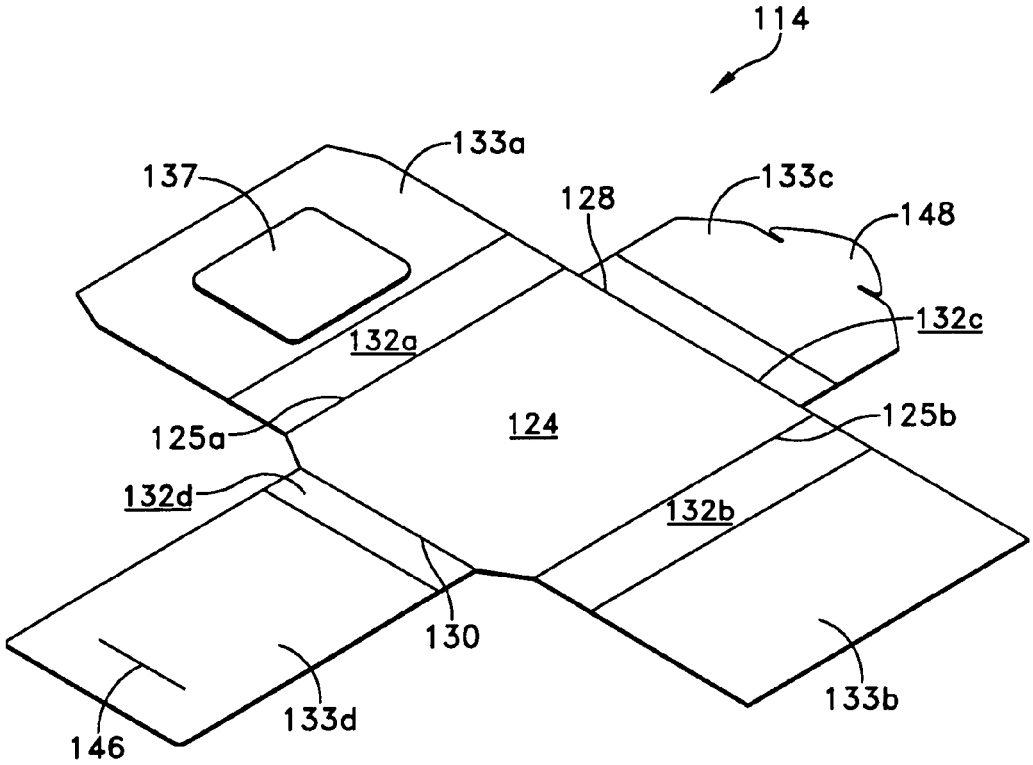
FIG. 15 is a perspective view of the sleeve of FIG. 14.
Figure 16:
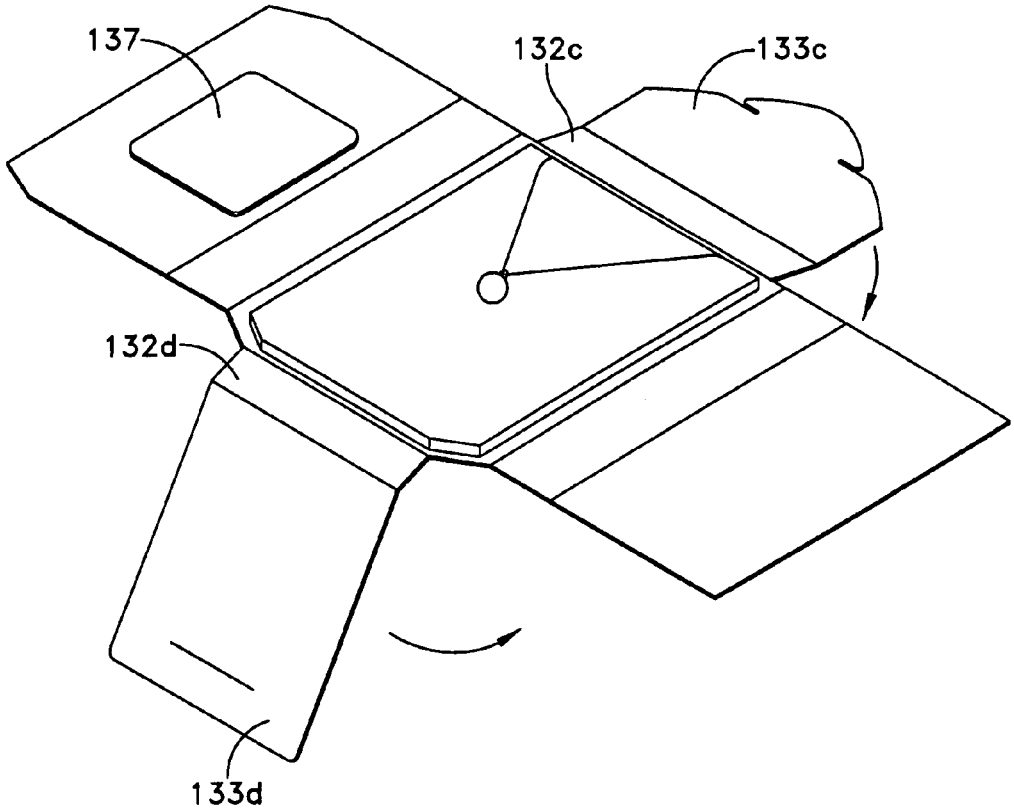
FIG. 16 is a perspective view of the base member and sleeve of FIG. 11 in a first position during assembly.
Figure 17:
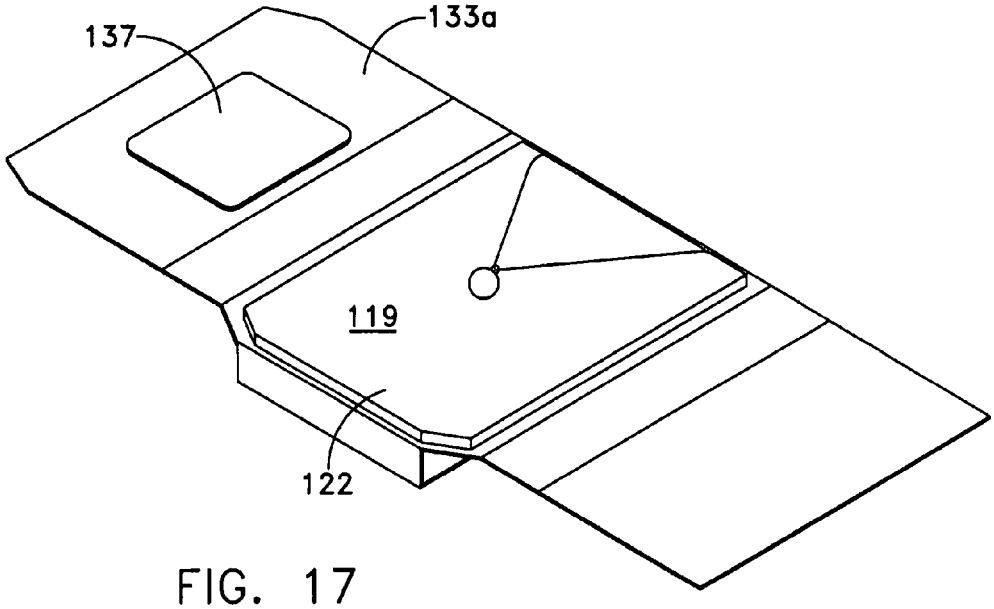
FIG. 17 is a perspective view of the base member and sleeve of FIG. 11 in a second position during assembly.

Referring now to FIGS. 14 and 15, the sleeve 114 preferably includes front member 124 which covers at least a portion of the front surface 119 of the display pad 122 during use. In order that the ornamental object 111 be viewable by a consumer, it is preferred that the front member 124 be made of a material which is see through, for example a transparent plastic material, or alternately, that it includes a window (not shown) for viewing the ornamental object therethrough. The front member 124 preferably includes side edges 125*a*, 125*b* as well as a top edge 128 and a bottom edge 130. In the present embodiment, foldable side tabs 132*a*, 132*b*, 132*c* and 132*d* extend from side edges 124*a*, 125*b* as well as top edge 128 and bottom edge 130, respectively. The side tabs 132*a*–132*d* may preferably be defined by a pre-scored or a predetermined weakened area along which the side tabs may be folded so as to readily fit around a portion of the display pad and bottom member, as illustrated in the drawings.

Figure 18:
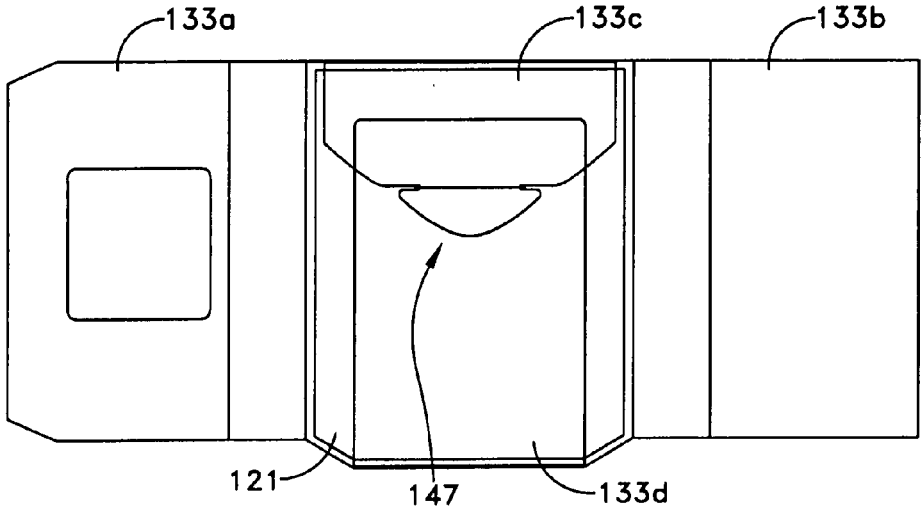
FIG. 18 is a rear plan view of the base member and sleeve of FIG. 17.
Figure 19:
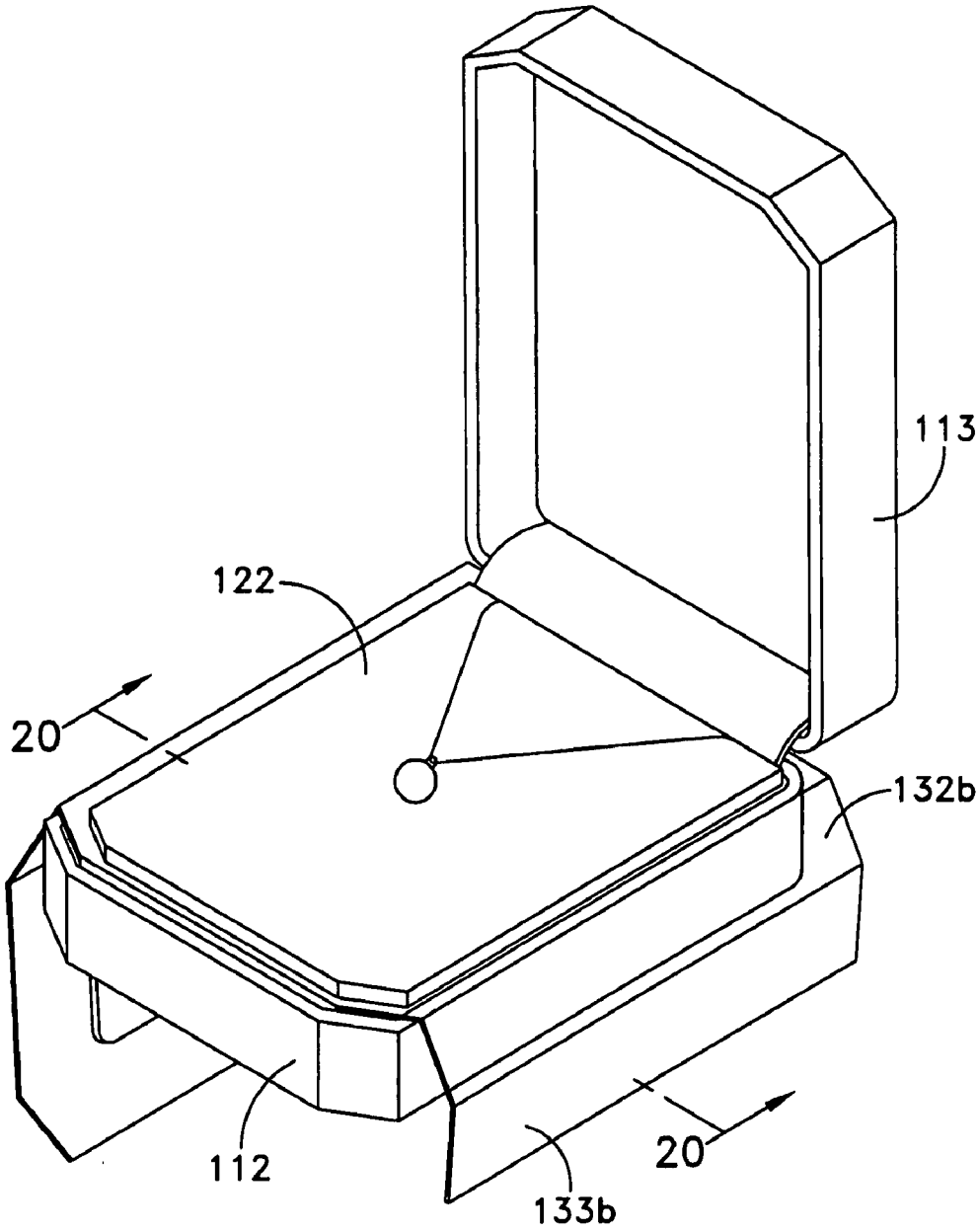
FIG. 19 is a perspective view of the display container during assembly of the sleeve around the display box.

In the present embodiment, side tabs 132*c* and 132*d* extend from top edge 128 and bottom edge 130, respectively, and are dimensioned to fit between an interior surface 134 (FIG. 12) of two of the side walls, for example 116*c*, 116*d*, and side edges 136 of the display pad 122. As best shown in FIG. 18, interior tabs 133*c* and 133*d* preferably extend from side tabs 132*c, d* and are constructed and arranged to fit over rear surface 121 of the display pad. The tabs 133*c*, 133*d* are preferably removably secured around the display pad 122. In the present embodiment, the interior tabs 133*c, d* include an overlapping portion and are preferably removably interengaged by a locking member 147 when assembled. One of the interior tabs may preferably include an opening or female receptacle 146, while the other tab includes a corresponding flap 148 or male member which together form the locking member 147. The flap 148 is insertable within the opening 146 in order to secure the sleeve 114 over the pad 122. Alternately, the interior tabs 133*a, b* may be secured together, or to the rear surface 121 of the display pad by adhesive, or the like. As illustrated, the interior tabs 133*c, d* may have different shapes and be different sizes, or may be sized the same, as would be known to those of skill in the art.

Extending from side edges 125*a, b* are side tabs 132*a, b* which are preferably dimensioned to fit over at least a pair of the side walls 16*a* and 16*b* of the bottom member 112 and support a first, exterior rear tab 133*a* and a second, exterior rear tab 133*b*. A score line may also be provided between the side edges 125*a, b* and the rear tabs 133*a, b* the rear tabs being foldable along the score lines to facilitate placement of the sleeve over the side walls 16*a, b* of bottom member 112. The exterior tabs 133*a, b* are sized and arranged to fit over a portion of the exterior surface of the back wall 120 of bottom member 112. In the present embodiment, the exterior tabs 133*a, b* include an overlapping portion which may be secured together by adhesive, or the like, or which may be secured to the back wall 120 or secured together by a locking member. As illustrated, the rear or exterior tabs 133*a, b* may have different sizes, or may be sized the same, as would be known to those of skill in the art. An electronic article surveillance (EAS) member 137 may be secured to one of the exterior tabs 133*a, b* in order to provide a theft deterrent, as known to those of skill in the art. Such EAS members are available from a number of sources and may alternately be applied to the box on either the exterior, or interior surface.

Figure 20:
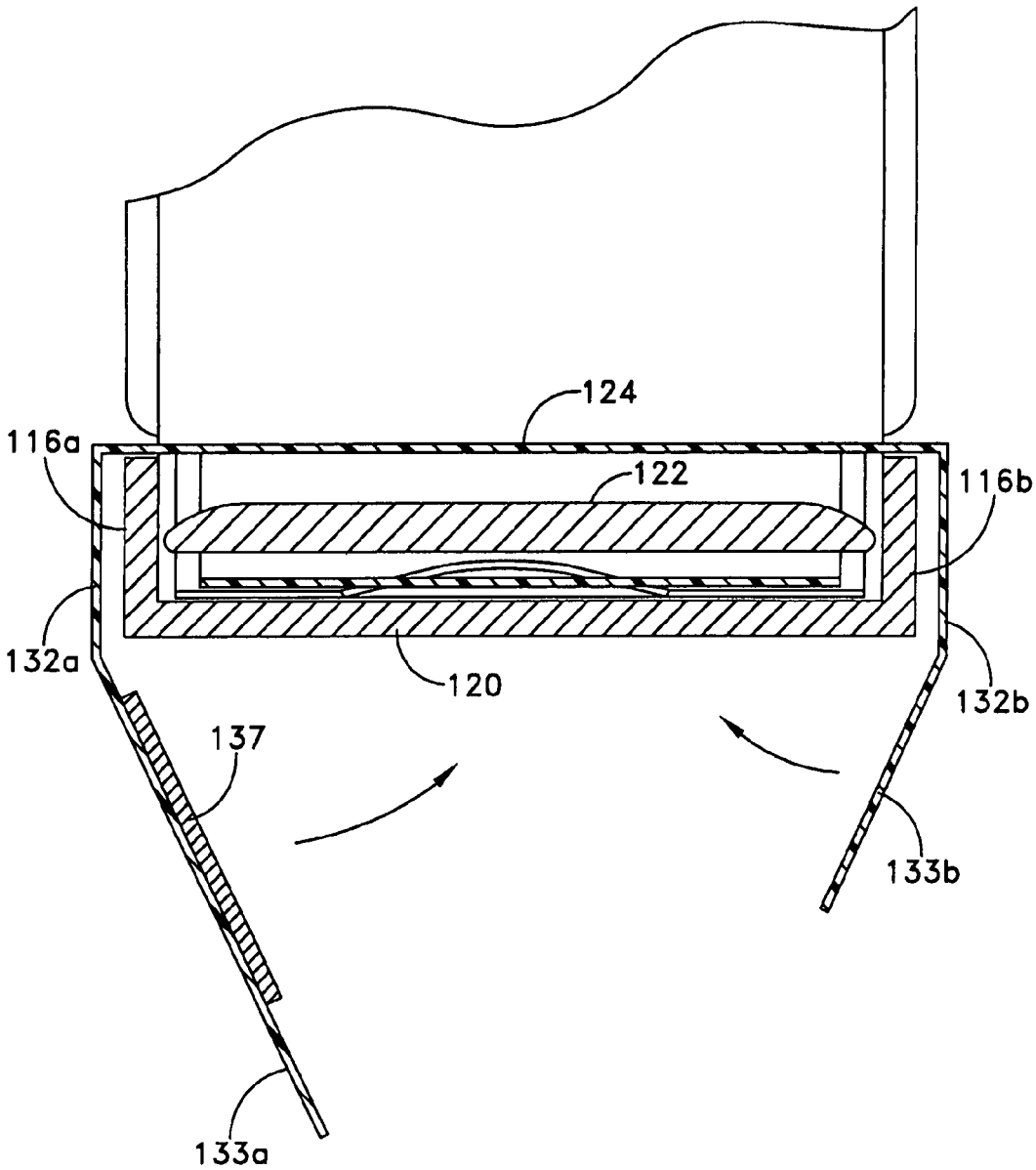
FIG. 20 is a cross-sectional view taken along lines 20—20 of FIG. 19 during assembly.
Figure 21:
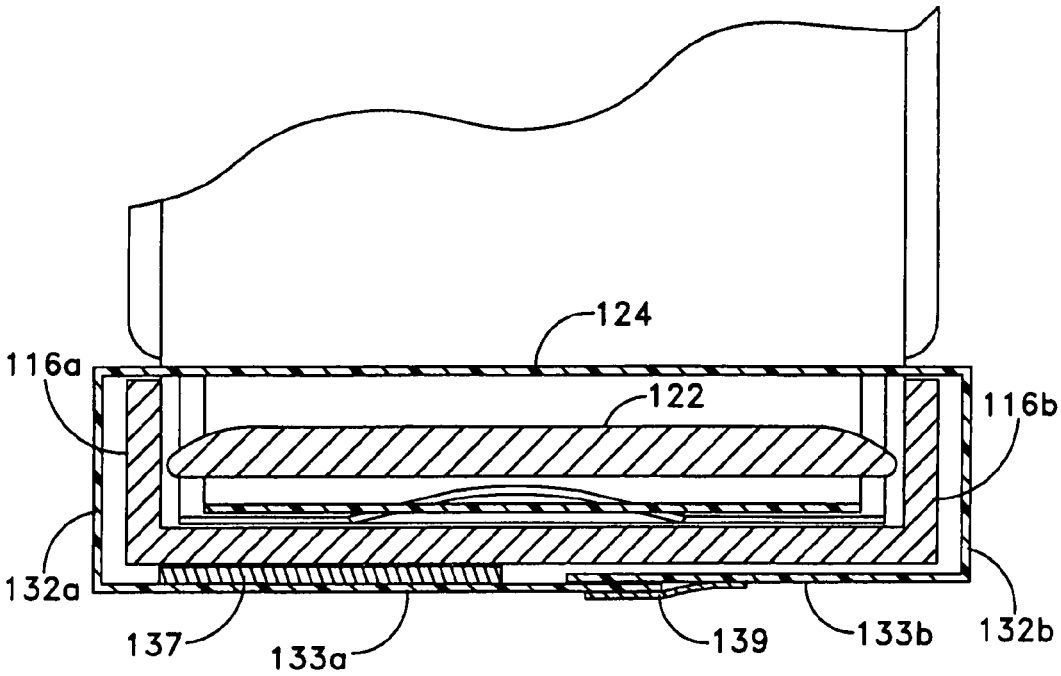
FIG. 21 is a cross-sectional view of FIG. 20 after assembly.
Figure 22:
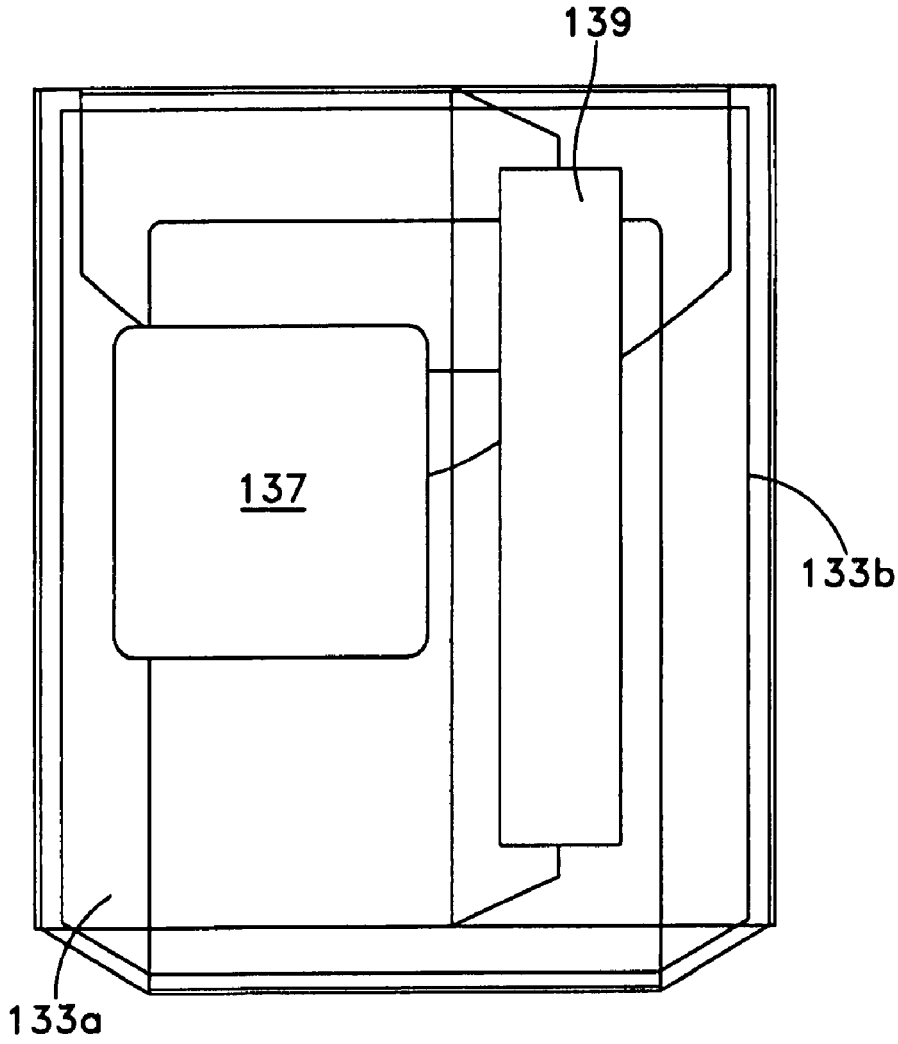
FIG. 22 is a rear plan view of the display container and sleeve after assembly.

Assembly of the display box and sleeve will now be described with reference to FIGS. 11–22. In use the ornamental object 111 is supported on the display pad 122. Once the ornamental object is placed on the display pad, the sleeve 114 may be positioned over the ornamental object and removably secured around the bottom member. In order to secure the sleeve, the sleeve 114 is preferably positioned such that the front member 124 overlays a portion of the front surface 119 of the display pad 122 ornamental object 111. The side tabs 132*c* and 132*d* are folded around the pad (FIG. 16) and inserted between the interior surface 134 of the side walls of the bottom member and adjacent sides 136 of the display pad. Interior tabs 133*c* and 133*d* preferably extend and are secured over rear surface 121 of the display pad. The display pad 122 is then inserted within bottom member 112, such that the sides 136 of the display pad 122 are positioned adjacent the interior surface 134 of the bottom member and the interior tabs are positioned adjacent the back wall 120. In order to secure the sleeve 114, side tabs 132*c, d* are preferably positioned over at least a pair of the side walls 16*a* and 16*b* of the bottom member 112 (FIG. 20). Thereafter, the exterior tabs 133*a, b* are extended over the exterior of the back wall 120 of the bottom member 112 and are removably secured over the bottom member, for example by a sticker 139 (FIG. 22) which can also be used to conceal the connection. If a cover 113 is provided, is may be placed over the bottom member 112 to cover the ornamental object in a closed position.

Figure 23:
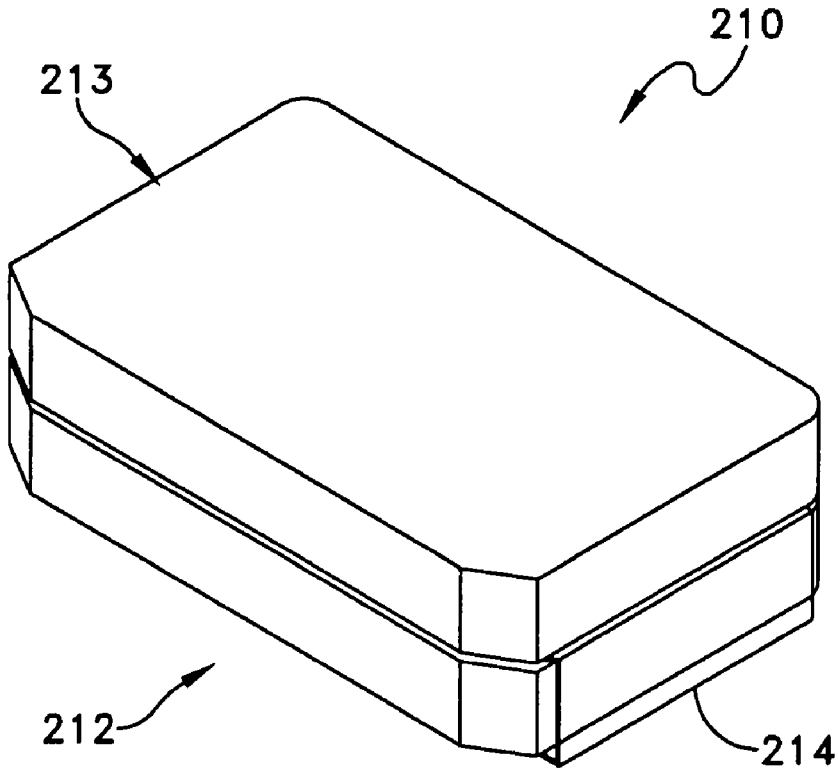
FIG. 23 is a perspective view of an alternate embodiment of the display box of FIG. 11.
Figure 24:
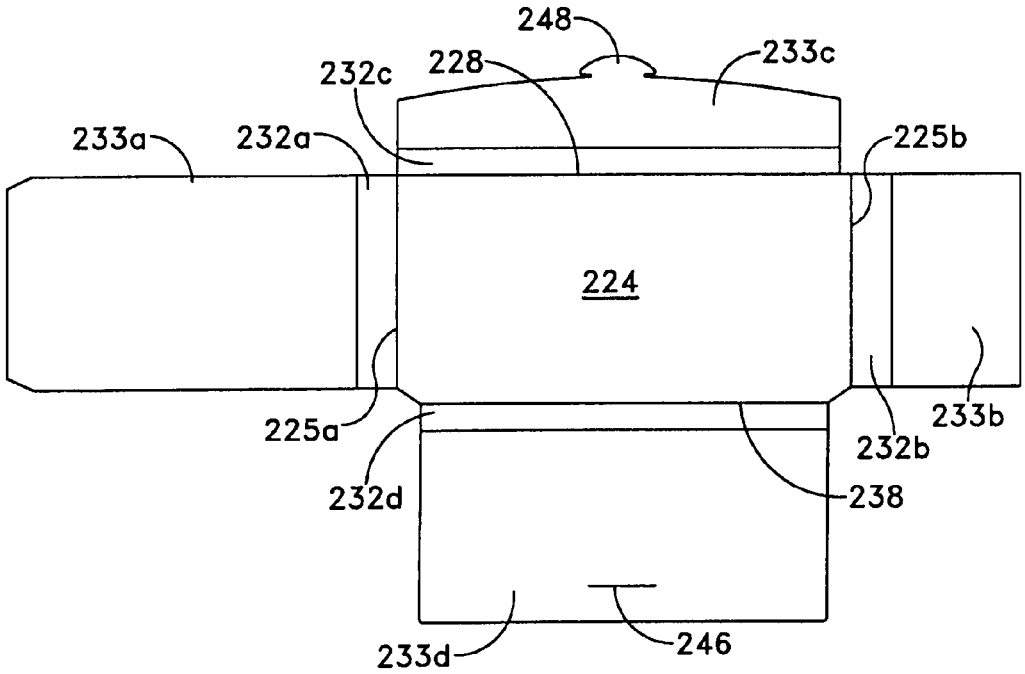
FIG. 24 is a top plan view of the sleeve of FIG. 23.
Figure 25:
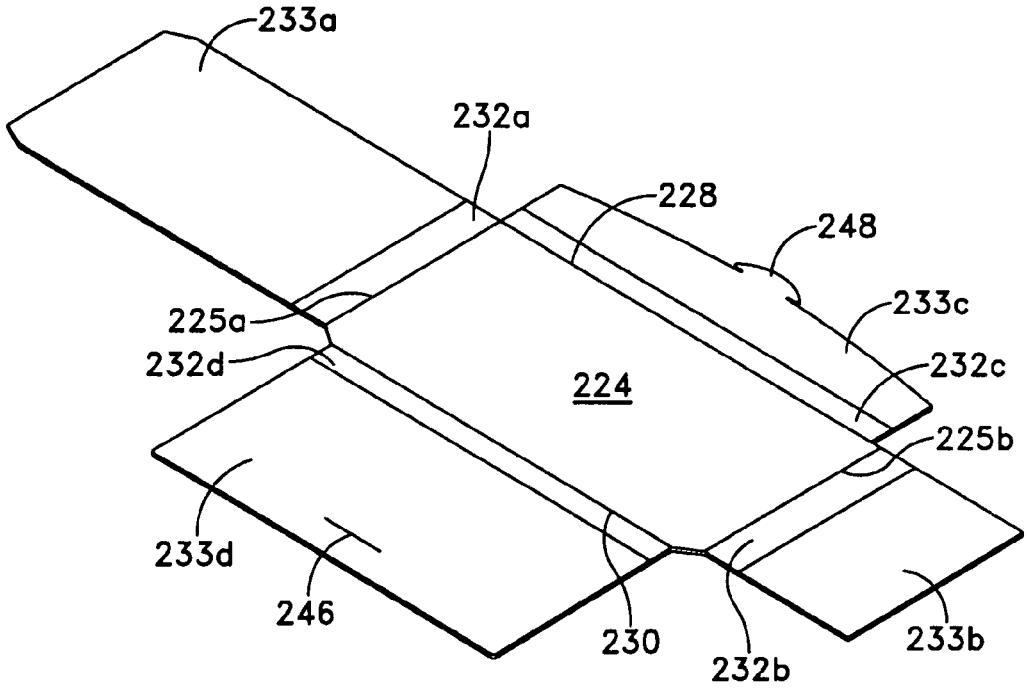
FIG. 25 is a perspective view of the sleeve of FIG. 24.

Referring now to FIGS. 23–25 an alternate embodiment of the display box 110 of FIGS. 11–22 is illustrated. In this embodiment, all parts which are the same, or similar to, corresponding parts in the previous embodiments are noted with the same two last numbers, but preceded by the numeral "2". This embodiment is identical to the embodiment of FIGS. 11–22, except that the size and shape of the display box 110 has been modified, as has the size and shape of the sleeve 214. In particular, the corners of the bottom member 212 and cover 213 have been rounded and are more rectangular in shape, and the sleeve 214 has a more rectangular configuration. Other than the differences in appearance, the embodiment of FIGS. 23–25 functions in the same manner as that of FIGS. 11–22. Namely, the sleeve 214 is preferably positioned such that the front member 224 overlays a portion of the front surface 219 of the display pad 222 and ornamental object 211. The side tabs 232*c* and 232*d* are folded and inserted between the interior surface 234 of the side walls of the bottom member and adjacent sides 236 of the display pad. Interior tabs 233*a* and 233*b* preferably extend and are secured over rear surface 221 of the display pad. The display pad 222 is then inserted within bottom member 212, such that the sides 236 of the display pad 222 are positioned adjacent the interior surface 234 of the bottom member and the interior tabs are positioned adjacent the back wall 220. In order to secure the sleeve 214, side tabs 232*c, d* are preferably positioned over at least a pair of the side walls 216*a* and 216*b* of the bottom member 212. Thereafter, the exterior tabs 233*a, b* are extended over the exterior of the back wall 220 of the bottom member 212 and are removably secured over the bottom member. If a cover 213 is provided, is may be placed over the bottom member 212 to cover the ornamental object in a closed position.

As will be appreciated, the display packages disclosed herein display an ornamental object in an attractive and reliable fashion, while also discouraging removal of the object and/or damage to the object by securing a sleeve as described above with respect to the embodiments.

It will be understood that various modifications may be made to the embodiment disclosed herein. For example, a display pad may be utilized with the box to support the ornamental object, and the object itself may be any type of object, other than a necklace. Also, the size and shape of the box and sleeve may be varied, as would be known to those of skill in the art. In addition, the "pair of tabs" and like members may have varied sizes and may not be the same size as each other. The cover may or may not be provided and may be provided as a separate member which is not secured to the bottom member. Therefore, the above description should not be construed as limiting, but merely as exemplifications of a preferred embodiment. Those skilled in the art will envision other modifications within the scope, spirit and intent of the invention.

The claims should not be read as limited to the described order or elements unless stated to that effect. Therefore, all embodiments that come within the scope and spirit of the following claims and equivalents thereto are claimed as the invention.

What is claimed is:

1. A display package for supporting an ornamental object, the display package comprising:

a bottom member including one or more side walls and a back wall;

a cover constructed and arranged to fit on the bottom member and moveable between an open and a closed position;

a display pad including a front surface constructed and arranged to support the ornamental object and dimensioned to fit between the one or more side walls of the bottom member and a rear surface opposite the front surface;

a sleeve including:

a. a front member constructed and arranged to fit over at least a portion of the front surface of the display pad;

b. a first pair of side tabs extending from the front member and constructed and arranged to fit within the bottom member between an interior surface of the side walls of the bottom member and the display pad;

c. a second pair of side tabs extending from the front member, each side tab supporting a corresponding exterior tab; and wherein in an assembled position the exterior tabs are positioned and secured over at least a portion of an exterior surface of the bottom member, and the front member is sandwiched between the cover and the bottom member in the closed position.

2. The display package of claim 1, wherein the sleeve further includes a pair of interior tabs supported by the first pair of side tabs and wherein in the assembled position the interior tabs are positioned and secured over the rear surface of the display pad.

3. The display package of claim 2, wherein the sleeve further includes a locking member constructed and arranged to removably secure the pair of interior tabs around the display pad.

4. The display package of claim 3, wherein the locking member includes an opening disposed through one of the interior tabs and a corresponding flap supported on the other of the interior tabs, the flap and opening matingly engaging each other so as to secure the interior tabs around the display pad in the assembled position.

5. The display package of claim 1, wherein the cover is secured to the bottom member by a hinge.

6. The display package of claim 1, wherein the front member is transparent such that the ornamental object is visible when the cover is in an open position.

7. The display package of claim 1, further comprising an electronic article surveillance member supported on at least one of the sleeve, the bottom member, the display pad and the cover.

8. The display package of claim 2, wherein the front member, the first pair of side tabs, the second pair of side tabs, the interior tabs, and exterior tabs are formed as a single, unitary member.

9. The display package of claim 8, wherein a pre-formed weakened line is disposed between the front member and the first pair of side tabs, the front member and the second pair of side tabs, the first pair of side tabs and the interior tabs and the second pair of side tabs and the exterior tabs, so as to facilitate positioning of the sleeve.

10. A display package for supporting an ornamental object, the display package comprising:

a bottom member including one or more side walls and a back wall;

a cover constructed and arranged to fit on the bottom member and moveable between an open and a closed position;

a display pad including a front surface constructed and arranged to support the ornamental object and a rear surface opposite the front surface;

a sleeve including:

a. a front member constructed and arranged to fit over at least a portion of the front surface of the display pad;

b. a first pair of side tabs extending from the front member and constructed and arranged to fit within the bottom member between an interior surface of the side walls of the bottom member and the display pad, each of the first pair of side tabs supporting a corresponding interior tab;

c. a second pair of side tabs extending from the front member, each side tab supporting a corresponding exterior tab; and wherein in an assembled position the exterior tabs are positioned and secured over at least a portion of an exterior surface of the bottom member and the interior tabs are positioned and secured over the rear surface of the display pad.

11. The display package of claim 10, wherein the cover is secured to the bottom member by a hinge.

12. The display package of claim 10, wherein the front member is transparent such that the ornamental object is visible when the cover is in an open position.

13. The display package of claim 10, further comprising an electronic article surveillance member supported on one of the sleeve, the bottom member, the display pad and the cover.

14. A sleeve for protecting an ornamental object supported within a display package, the display package including a bottom member for supporting a display pad having a front surface constructed and arranged to support the ornamental object and a rear surface opposite the front surface, the sleeve comprising:

a front member constructed and arranged to fit over at least a portion of the front surface of the display pad;

a first pair of side tabs extending from the front member and constructed and arranged to fit within the bottom member between an interior surface of the bottom member and the display pad each of the first pair of side tabs supporting a corresponding interior tab;

a second pair of side tabs extending from the front member, each side tab supporting a corresponding exterior tab; and wherein in an assembled position the exterior tabs are positioned and secured over at least a portion of an exterior surface of the bottom member and the interior tabs are positioned and secured over the rear surface of the display pad.

15. The sleeve of claim 14, further comprising a locking member constructed and arranged to removably secure the pair of interior tabs around the display pad.

16. The sleeve of claim 15, wherein the locking member includes an opening disposed through one of the interior tabs and a corresponding flap supported on the other of the interior tabs, the flap and opening matingly engaging each other so as to secure the interior tabs around the display pad in the assembled position.

17. The sleeve of claim 14, wherein the front member is transparent such that the ornamental object is visible through the front member.

18. The sleeve of claim 14, wherein the front member, the first pair of side tabs, the second pair of side tabs, the interior tabs, and exterior tabs are formed as a single, unitary member.

19. The sleeve of claim 18, wherein a pre-formed weakened line is disposed between the front member and the first pair of side tabs, the front member and the second pair of side tabs, the first pair of side tabs and the interior tabs and the second pair of side tabs and the exterior tabs, so as to facilitate positioning of the sleeve.

* * * * *